US008493277B2

(12) United States Patent
Lam et al.

(10) Patent No.: US 8,493,277 B2
(45) Date of Patent: Jul. 23, 2013

(54) LEAKY CAVITY RESONATOR FOR WAVEGUIDE BAND-PASS FILTER APPLICATIONS

(75) Inventors: Tai A. Lam, Kent, WA (US); Claudio G. Parazzoli, Seattle, WA (US); Minas H. Tanielian, Bellevue, WA (US)

(73) Assignee: The Boeing Company, Chicago, IL (US)

( * ) Notice: Subject to any disclaimer, the term of this patent is extended or adjusted under 35 U.S.C. 154(b) by 695 days.

(21) Appl. No.: 12/491,554

(22) Filed: Jun. 25, 2009

(65) Prior Publication Data

US 2010/0328175 A1 Dec. 30, 2010

(51) Int. Cl.
*H01Q 13/00* (2006.01)

(52) U.S. Cl.
USPC ..... 343/778; 343/772; 333/219.1

(58) Field of Classification Search
USPC ..... 343/772, 778, 776, 785; 333/219.1
See application file for complete search history.

(56) References Cited

U.S. PATENT DOCUMENTS

| | | | | |
|---|---|---|---|---|
| 3,697,898 | A * | 10/1972 | Blachier et al. | 333/21 A |
| 4,721,933 | A * | 1/1988 | Schwartz et al. | 333/212 |
| 5,012,211 | A * | 4/1991 | Young et al. | 333/212 |
| 5,517,203 | A * | 5/1996 | Fiedziuszko | 343/756 |
| 5,629,266 | A * | 5/1997 | Lithgow et al. | 505/210 |
| 5,804,534 | A * | 9/1998 | Zaki | 505/210 |
| 5,838,213 | A * | 11/1998 | Huang | 333/99 S |
| 5,889,449 | A * | 3/1999 | Fiedziuszko | 333/239 |
| 6,215,443 | B1 * | 4/2001 | Komatsu et al. | 343/700 MS |
| 6,281,769 | B1 * | 8/2001 | Fiedziuszko | 333/239 |
| 6,603,374 | B1 * | 8/2003 | Schmitt et al. | 333/219.1 |
| 2003/0227350 | A1 * | 12/2003 | Abdelmonem | 333/99 S |
| 2005/0116874 | A1 * | 6/2005 | El-Mahdawy et al. | 343/806 |
| 2006/0255875 | A1 * | 11/2006 | Iio | 333/26 |

FOREIGN PATENT DOCUMENTS

| | | | |
|---|---|---|---|
| GB | 1402338 A | * | 8/1975 |
| WO | WO98/12767 | * | 3/1998 |

OTHER PUBLICATIONS

Hunter, I.C. et al. "Microwave Filters—Applications and Technology." IEEE Transactions on Microwave Theory and Techniques, vol. 50, No. 3, pp. 794-805, Mar. 2002.

* cited by examiner

*Primary Examiner* — Hoanganh Le
(74) *Attorney, Agent, or Firm* — Charles L. Moore; Moore & Van Allen PLLC

(57) ABSTRACT

A leaky cavity resonator that includes a waveguide, the waveguide being filled with a dielectric material, and at least two complementary split ring resonators (CSRRs), the CSRRs residing inside the waveguide parallel to each other placed symmetrically both radially and in height, a leaky resonant cavity being formed between the at least two CSRRs and a wall of the waveguide. A frequency band of the leaky cavity resonator is adjustable by varying a distance w between at least one outside perimeter of at least one CSRR and an interior wall of the waveguide. A frequency band of the leaky cavity resonator is also adjustable by varying a size of the leaky resonant cavity. The at least two CSRRs each have at least one stub connecting to a wall of the waveguide. A frequency band of the leaky cavity resonator is also adjustable by varying a size of the stubs.

18 Claims, 5 Drawing Sheets

LEAKY CAVITY RESONATOR FOR WAVEGUIDE BAND-PASS FILTER APPLICATIONS

This invention was made with Government support under HR011-05-C-0068 awarded by DARPA. The Government has certain rights in this invention.

BACKGROUND

The present disclosure is related to waveguides, and more specifically leaky cavity resonators for waveguide band-pass filter applications.

There are many types of antenna used to transmit signals. One type is a phased array antenna (PAA). With phased array antennas, a separate array is used to transmit and to receive data. However, phased array antennas are prone to co-site interference (e.g., the transmit antenna signal will couple unwanted energy into the received antenna, or spurious sources at different frequencies could couple energy back into the transmit antenna). Receive antennas have problems in that the tail end of frequencies are picked up and spill over from the transmit antenna. Current solutions use band-pass filters where only certain frequencies get through. Cascaded linear ceramic resonators are used that have a high Q factor, therefore, only allowing a narrow band of frequencies through and filtering others out. The resonators often require higher dielectric materials and most importantly an appreciable thickness to work. However, these must be cascaded causing an increase in size. When these cascaded resonators are put in a waveguide, this substantially increases the height and the weight of the waveguide in a phased array antenna. Therefore, current solutions are problematic in that they require a substantial increase in system thickness and weight.

SUMMARY

According to another aspect of the present disclosure, a leaky cavity resonator includes a waveguide, the waveguide being filled with a dielectric material, and at least two complementary split ring resonators (CSRRs), the CSRRs residing inside the waveguide parallel to each other placed symmetrically both radially and in height, a leaky resonant cavity being formed between the at least two CSRRs and a wall of the waveguide.

According to a still further aspect of the present disclosure, a leaky cavity resonator includes a waveguide, the waveguide being filled with a dielectric material, and at least one complementary split ring resonator (CSRR), the CSRR residing inside the waveguide, a leaky resonant cavity being formed between the at least one CSRR and a wall of the waveguide.

According to a still further aspect of the present disclosure, a phased array antenna includes a transmitting array, and a receiving array, the receiving array comprising a plurality of waveguides, each waveguide comprising: at least two complementary split ring resonators (CSRRs), the CSRRs residing inside the waveguide parallel to each other placed symmetrically both radially and in height, a leaky resonant cavity being formed between the at least two CSRRs and a wall of the waveguide.

The features, functions, and advantages that have been discussed can be achieved independently in various embodiments of the present disclosure or may be combined in yet other embodiments further details of which can be seen with reference to the following description and drawings.

BRIEF DESCRIPTION OF THE DRAWINGS

The present disclosure is further described in the detailed description which follows in reference to the noted plurality of drawings by way of non-limiting examples of embodiments of the present disclosure in which like reference numerals represent similar parts throughout the several views of the drawings and wherein.

DETAILED DESCRIPTION

The following detailed description of embodiments refers to the accompanying drawings, which illustrate specific embodiments of the disclosure. Other embodiments having different structures and operation do not depart from the scope of the present disclosure.

Embodiments according to the present disclosure provide a leaky cavity resonator that includes one or more metallic layers that may be inserted into existing waveguides without increasing the size or weight of the waveguide. According to embodiments of the present disclosure, individual each leaky layer may be composed of a complimentary split ring resonator (CSRR). In an SRR, the circular disks or rings may be made of a conductive material such as copper with a cut in it and is surrounded by air. The inductance along the ring and capacitance in the gap form a resonant inductance-capacitance (LC) circuit. For the case of a CSRR, air and copper switch so the rings are now made of air and the splits in the surroundings are made of a conductive material such as copper. There is a gap "w" between the outer edges of the disk and the wall of the waveguide. The circular disks may be connected to the waveguide wall by one or more stubs that extend from and are part of the circular disk. The stubs may be concentric with the disk and subtend an angle θ relative to the center of the disk. The dimensions of both w and θ may be optimized to achieve the desired resonant frequencies and band-pass characteristics for the waveguide.

A similar sized disk without a stub may not form a resonant system and most of the energy may be reflected. According to embodiments of the present disclosure, one CSRR layer may be inserted into a waveguide to form a leaky cavity. Further, according to embodiments of the present disclosure, two or more CSRR layers may be stacked and inserted into a waveguide to form one or more leaky cavities. When two layers are stacked to form a leaky cavity, the pass-band widens and the outer band drop-off (i.e., the skirt) falls off steeply. According to embodiments of the present disclosure, for better symmetry and polarization preservation, multiple stubs (e.g., four) may be used.

Figure 1A:
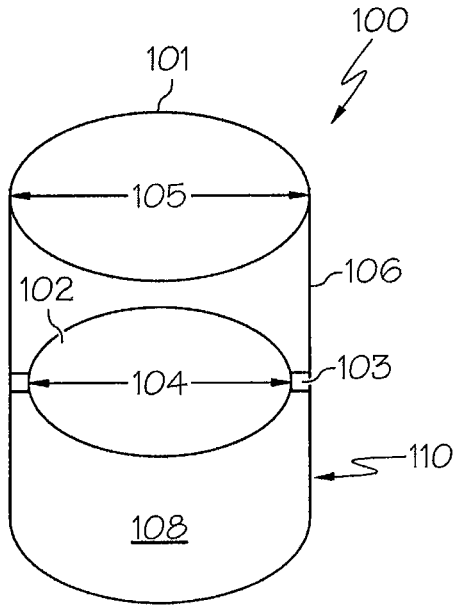
FIG. 1A is a diagram of a leaky cavity resonator according to an example embodiment of the present disclosure.

FIG. 1A shows a diagram of a leaky cavity resonator according to an example embodiment of the present disclosure. The leaky cavity resonator 100 may include a waveguide 101 with a diameter 105. The waveguide 101 may have a complementary split ring resonator (CSRR) 102 of a particular diameter 104 inserted inside. The split ring resonator 102 may include one or more stubs 103 that may connect the CSRR 104 to an exterior wall 106 of the waveguide 101. The waveguide 101 may be filled with a dielectric material 108 such as, for example, Rexolite. The complementary split ring resonator 102 may be composed of a conductive material such as, for example, copper. The waveguide 101 may be a phased array antenna waveguide 110.

Figure 1B:
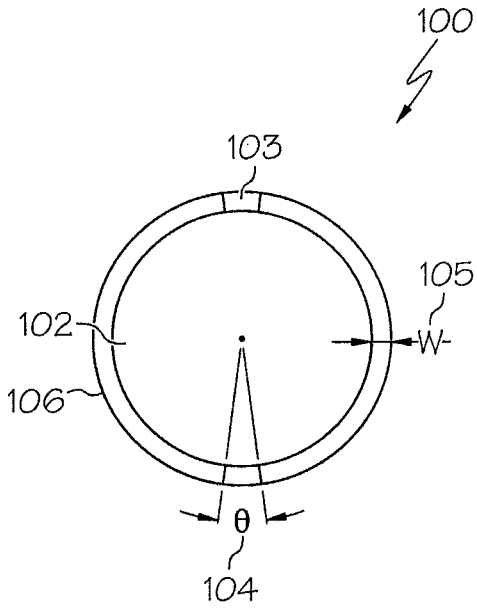
FIG. 1B is a top view of the leaky cavity resonator of FIG. 1A.

FIG. 1B shows a top view of the leaky cavity resonator of FIG. 1A. This view shows the leaky cavity resonator 100 and the complementary split ring resonator 102 with two stubs 103 that connect the CSRR 102 to a wall 106 of the waveguide 101. This top view illustrates that each of the stubs 103 is concentric with the CSRR disk 102 and may subtend an angle θ relative to the center of the disk 102. Also shown is the gap "w" between the complementary split ring resonator 102 and the exterior wall 106 of the waveguide 101. Both the gap "w" and the angle θ, which represents a width of the stub 103, may be adjusted to adjust a frequency band of the leaky cavity resonator 100. In addition, although the stubs 103 are shown to be of the same size, embodiments according to the present disclosure may include stubs of different sizes for the same CSRR disk.

Figure 2A:
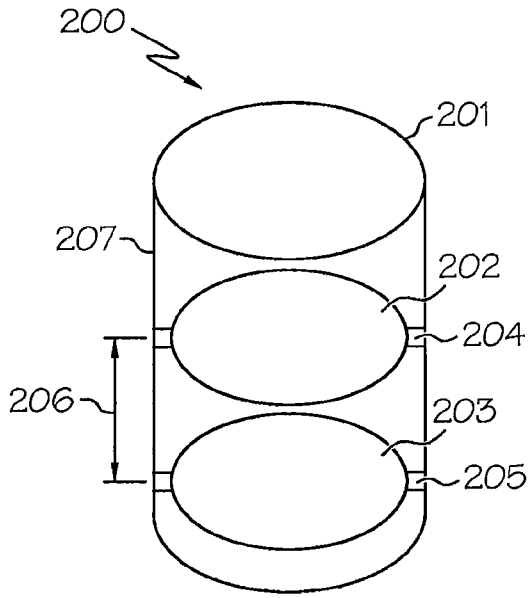
FIG. 2A is a diagram of a leaky cavity resonator according to another example embodiment of the present disclosure.

FIG. 2 shows a diagram of a leaky cavity resonator according to another example embodiment of the present disclosure. In this embodiment, the leaky cavity resonator 200 includes a waveguide 201 and two complementary split ring resonators 202, 203. The first complementary split ring resonator 202 has stubs 204 that connect the first complementary split ring resonator 202 to a wall 207 of the waveguide 201. Further, a second complementary split ring resonator 203 may similarly have one or more stubs 205 that connect the second complementary split ring resonator 203 to the wall 207 of the waveguide 201. In this example embodiment, the two complementary split ring resonators 202, 203 reside inside the waveguide 201 and may be placed parallel to each other symmetrically both radially and in height. A leaky resonant cavity 206 may be formed between the first complementary split ring resonator 202 and the second complementary split ring resonator 203.

Figure 2B:
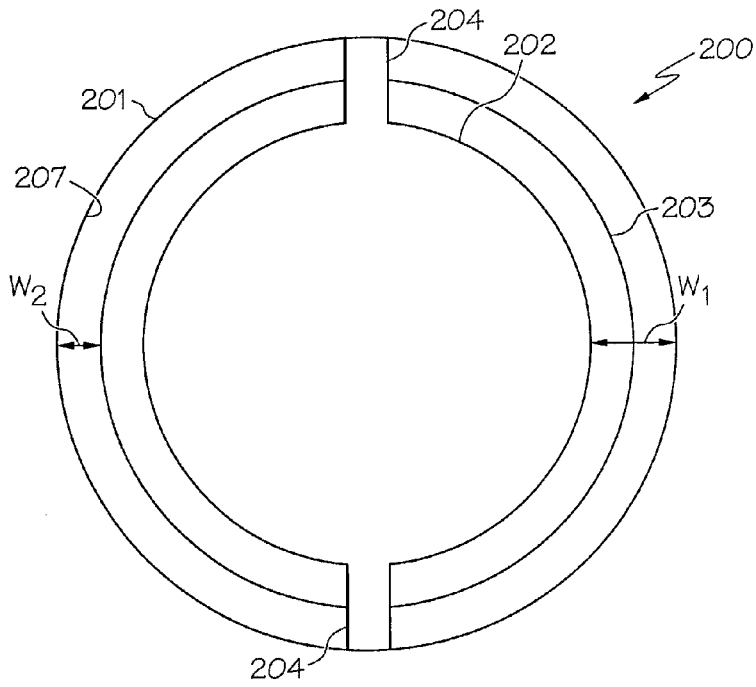
FIG. 2B is a top elevation view of the leaky cavity resonator of FIG. 2A.

The waveguide 201 may be filled with a dielectric material. A higher dielectric material may be used to reduce the size of the leaky cavity resonator 200. Each of the complementary split ring resonators 202, 203 may be comprised of a conductive material such as, for example, copper. A frequency band of the leaky cavity resonator 200 may be adjustable by varying the distance "w" between at least one outside edge of at least one of the complementary split ring resonators 202, 203 and an exterior wall 207 of the waveguide 201. Further, a frequency band of the leaky cavity resonator 200 may be adjustable by varying a size of the cavity 206 between the first complementary split ring resonator 202 and the second complementary split ring resonator 203. Therefore, according to embodiments of the present disclosure, several items may be individually adjusted to achieve a desired resonance frequency and band pass characteristic for the leaky cavity resonator 200 such as, a size of stubs 204 on the first complementary split ring resonator 202 and the size of stubs 205 on the second complementary split ring resonator 203, and as illustrated in FIG. 2B, a distance "w1" between the first complementary split ring resonator 202 to the exterior wall 207 of the waveguide 201, and the distance "w2" between the second complementary split ring resonator 203 and the wall 207 of the waveguide 201. Where "w1" is larger than "w2."

Figure 3:
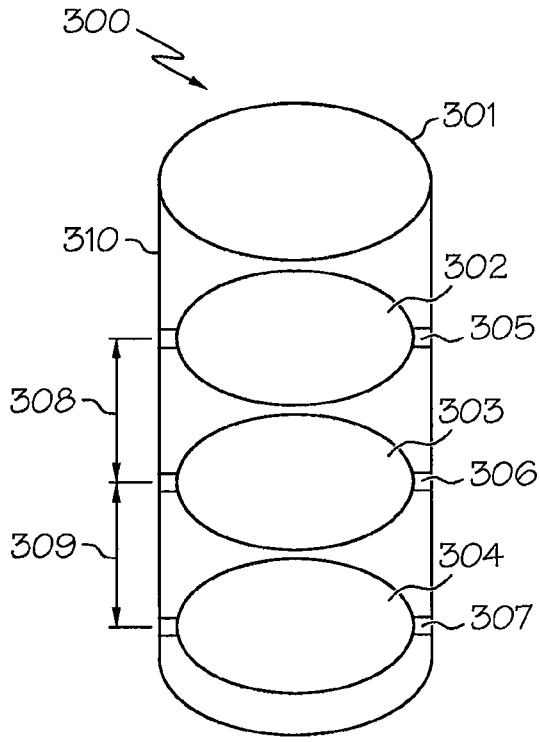
FIG. 3 is a diagram of a leaky cavity resonator according to a further example embodiment of the present disclosure.

FIG. 3 shows a diagram of a leaky cavity resonator according to a further example embodiment of the present disclosure. In this embodiment, a leaky cavity resonator 300 includes a waveguide 301, a first complementary split ring resonator 302, a second complementary split ring resonator 303, and a third complementary split ring resonator 304, where each CSRR has associated at least one stub 305, 306, 307, respectively, that connect the CSRR to a wall 310 of the waveguide 301. A leaky resonant cavity 308 may be formed between the first complementary split ring resonator 302 and the second complementary split ring resonator 303. Similarly, a second leaky resonant cavity 309 may be formed between the second complementary split ring resonator 303 and the third complementary split ring resonator 304. Therefore, in this embodiment, two resonant cavities 308, 309 are formed. This embodiment may provide a much wider pass band for the leaky cavity resonator. Similarly, embodiments according to the present disclosure may have more than three complementary split ring resonators inserted into a waveguide and be within the scope of the present disclosure. Desired characteristics for a leaky cavity resonator (e.g., band-pass characteristics) may influence the number of complementary split ring resonators implemented in a particular leaky cavity resonator design.

Figure 4:
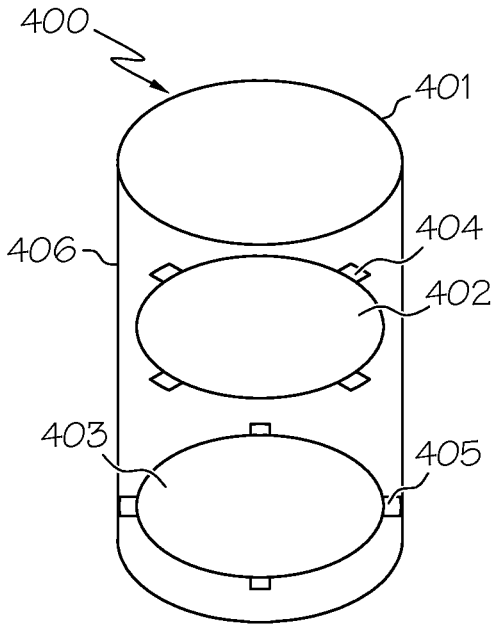
FIG. 4 is a diagram of a leaky cavity resonator according to a still further example embodiment of the present disclosure.

FIG. 4 shows a diagram of a leaky cavity resonator according to a still further example embodiment of the present disclosure. In this embodiment, a leaky cavity resonator 400 may include a waveguide 401, one or more complementary split ring resonators 402, 403 inserted into the waveguide 401 where one or more of the complementary split ring resonators 402, 403 may have one or more stubs 404, 405, respectively connecting the complementary split ring resonators 402, 403 to a wall of the waveguide 401. In this example embodiment, each of the two complementary split ring resonators 402, 403, each have four stubs 404, 405, respectively, that connect the complementary split ring resonators 402, 403 to a wall 406 of the waveguide 401. However, embodiments of the present disclosure are not limited to four and may include any number of stubs connecting a complementary split ring resonator to a wall of a waveguide. Desired characteristics for a leaky cavity resonator (e.g., band-pass characteristics) may influence the number of stubs implemented in a particular leaky cavity resonator design.

Figure 5:
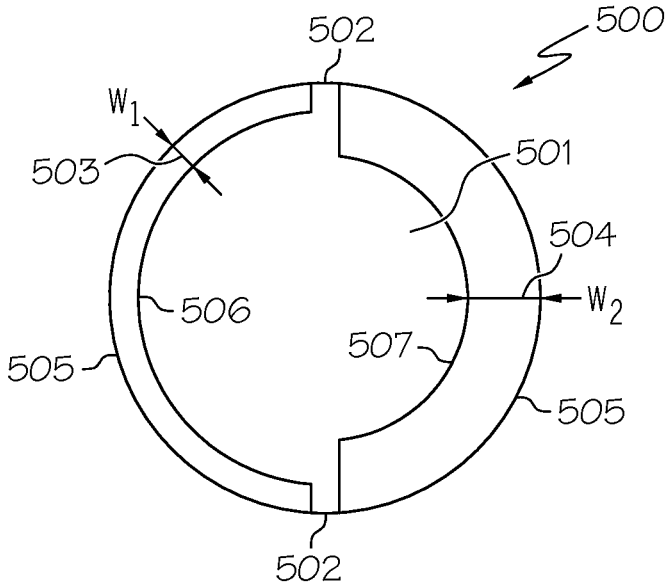
FIG. 5 is a top view of a leaky cavity resonator according to another example embodiment of the present disclosure.

FIG. 5 shows a top view of a leaky cavity resonator according to another example embodiment of the present disclosure. In this embodiment, a leaky cavity resonator 500 may include a complementary split ring resonator 501 that may not be relatively symmetrical in shape. In this example embodiment, the complimentary split ring resonator 501 may have a first outer edge 506 of a particular first radius from a center of the complimentary split ring resonator 501 and a second outer edge 507 of a different second radius from a center of the complimentary split ring resonator 501. Further, the first outer edge 506 may be a distance $w_1$ 503 from a wall 505 of the waveguide and the second outer edge 507 of the complementary split ring resonator 501 may be a different distance $w_2$ 504 from a different part of the wall 505 of the waveguide. In this example embodiment, the complementary split ring resonator 501 has two stubs 502 of the same size that each connect to a wall of the waveguide. The distance $w_1$ 503 and the distance $w_2$ 504 may be varied to tune the resonant frequency of the leaky cavity resonator 500 by changing the size of the first radius 506, and/or the size of the second radius 507 of the complementary split ring resonator 501. Although in this example embodiment, a complementary split ring resonator is shown with two different radii and two different associated distances to the exterior walls of a waveguide, a complementary split ring resonator may include more than two different radii and two different associated distances to the exterior walls of a waveguide and be included in a leaky cavity resonator and still be within the scope of the present disclosure.

Figure 6:
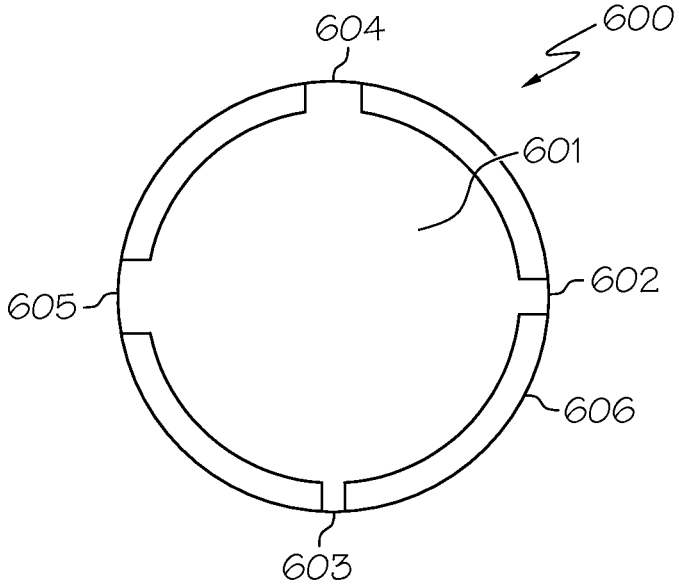
FIG. 6 is a diagram of a leaky cavity resonator according to a further example embodiment of the present disclosure.

FIG. 6 shows a diagram of a leaky cavity resonator according to a further example embodiment of the present disclosure. In this embodiment, a leaky cavity resonator 600 may include a waveguide and a complementary split ring resonator 601 that is inserted into the waveguide. This top view of the leaky cavity resonator 600 shows that the complementary split ring resonator 601 has multiple (four) stubs 602, 603, 604, 605 of varying sizes that each connect the complementary split ring resonator 601 to a wall 606 of the waveguide. It may be desired to have multiple different sized stubs depending on what characteristics are desired from the leaky cavity resonator 600 (e.g., a desired pass band of the leaky cavity resonator). Further, although four stubs are shown here of varying sizes, any number of stubs may be included on a complementary split ring resonator and each be of a different, or the same, or any combination thereof and still be within the scope of the present disclosure.

Figure 7:
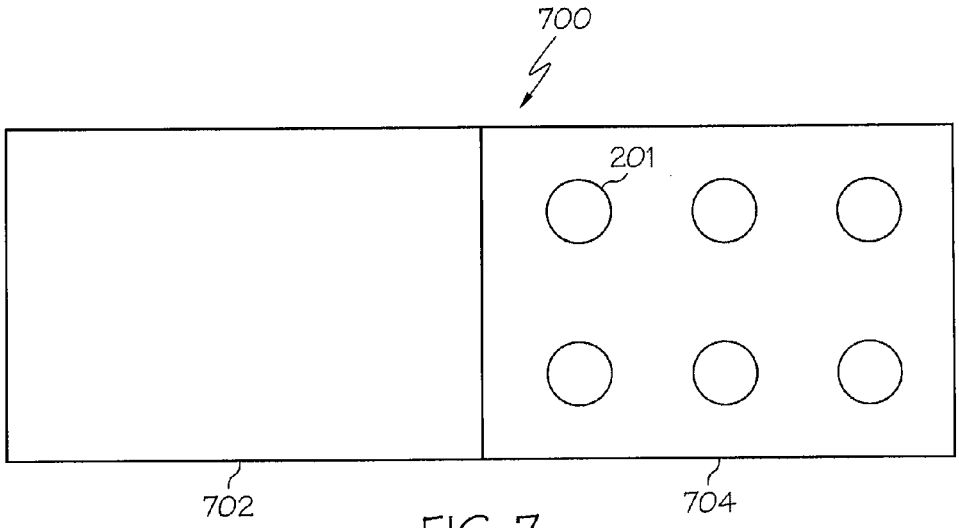
FIG. 7 is a diagram of a phased array antenna according to an example embodiment of the present disclosure.

FIG. 7 is a diagram of a phased array antenna 700 according to an example embodiment of the present disclosure. The phased array antenna 700 includes a transmitting array 702 and a receiving array 704. The receiving array 704 comprises a plurality of waveguides 201 similar waveguides 201 in FIG. 2. Each waveguide 201 comprises at least two complementary split ring resonators (CSRRs). The CSRRs residing inside the waveguide 201 parallel to each other placed symmetrically both radially and in height. A leaky resonant cavity being formed between the at least two CSRRs and a wall of the waveguide.

Although specific embodiments have been illustrated and described herein, those of ordinary skill in the art appreciate that any arrangement which is calculated to achieve the same purpose may be substituted for the specific embodiments shown and that the disclosure has other applications in other environments. This application is intended to cover any adaptations or variations of the present disclosure. The following claims are in no way intended to limit the scope of the disclosure to the specific embodiments described herein.

What is claimed is:

1. A leaky cavity resonator comprising:

a waveguide, the waveguide being filled with a dielectric material; and at least two complementary split ring resonators (CSRRs), the CSRRs residing inside the waveguide parallel to each other placed symmetrically both radially and in height, a leaky resonant cavity being formed between the at least two CSRRs and a wall of the waveguide, wherein an outside perimeter of one of the at least two CSRRs is a distance w1 from an interior wall of the waveguide and an outside perimeter of a second of the at least two CSRRs is a distance w2 from an interior wall of the waveguide, where w1 is larger than w2.

2. The resonator according to claim 1, wherein a frequency band of the leaky cavity resonator is adjustable by varying a distance w between at least one outside perimeter of at least one CSRR and an interior wall of the waveguide.

3. The resonator according to claim 1, wherein the at least two CSRRs comprise copper layers.

4. The resonator according to claim 1, wherein a frequency band of the leaky cavity resonator is adjustable by varying a size of the cavity.

5. The resonator according to claim 1, wherein the at least two CSRRs each have at least one stub connecting to a wall of the waveguide, the at least one stub having a length extending between the CSRR and the wall of the waveguide corresponding to a gap between each of the at least two CSRRs and the wall of the waveguide.

6. The resonator according to claim 1, wherein the waveguide comprises a phased-array antenna waveguide.

7. The resonator of claim 1, wherein the waveguide comprises a cylindrical wall.

8. A leaky cavity resonator comprising:

a waveguide, the waveguide being filled with a dielectric material; and at least one complementary split ring resonator (CSRR), the CSRR residing inside the waveguide, a leaky resonant cavity being formed between the at least one CSRR and a wall of the, wherein an outside perimeter of the at least one CSRR is a distance w1 from an interior wall of the waveguide and a second outside perimeter of the at least one CSRR is a distance w2 from an interior wall of the waveguide, where w1 is larger than w2.

9. The resonator according to claim 8, wherein a frequency band of the leaky cavity resonator is adjustable by varying a distance w between at least one outside perimeter of the at least one CSRR and an interior wall of the waveguide.

10. The resonator according to claim 8, wherein the at least one CSRR comprise copper layers.

11. The resonator according to claim 8, wherein the at least one CSRR has at least one stub connecting to a wall of the waveguide.

12. The resonator according to claim 8, wherein the waveguide comprises a phased-array antenna waveguide.

13. A phased array antenna comprising:

a transmitting array; and a receiving array, the receiving array comprising a plurality of waveguides, each waveguide comprising:

at least two complementary split ring resonators (CSRRs), the CSRRs residing inside the waveguide parallel to each other placed symmetrically both radially and in height, a leaky resonant cavity being formed between the at least two CSRRs, wherein an outside perimeter of one of the at least two CSRRs is a distance w1 from an interior wall of the waveguide and an outside perimeter of a second of the at least two CSRRs is a distance w2 from an interior wall of the waveguide, where w1 is larger than w2.

14. The phased array antenna according to claim 13, wherein a frequency band of each waveguide is adjustable by varying a distance w between at least one outside perimeter of at least one CSRR and an interior wall of the waveguide.

15. The phased array antenna according to claim 13, wherein a frequency band of each waveguide is adjustable by varying a size of the leaky resonant cavity.

16. The phased array antenna according to claim 13, wherein the at least two CSRRs each have at least one stub connecting to a wall of the waveguide.

17. A leaky cavity resonator comprising:

a waveguide, the waveguide being filled with a dielectric material; and at least two complementary split ring resonators (CSRRs), the CSRRs residing inside the waveguide parallel to each other placed symmetrically both radially and in height, a leaky resonant cavity being formed between the at least two CSRRs and a wall of the waveguide, wherein an outside perimeter of one of the at least two CSRRs is a distance w1 from an interior wall of the waveguide and a second outside perimeter of the one of the at least two CSRRs is a distance w2 from an interior wall of the waveguide, where w1 is larger than w2.

18. A leaky cavity resonator comprising:

a waveguide, the waveguide being filled with a dielectric material; and at least two complementary split ring resonators (CSRRs), the CSRRs residing inside the waveguide parallel to each other placed symmetrically both radially and in height, a leaky resonant cavity being formed between the at least two CSRRs and a wall of the waveguide, wherein the at least two CSRRs each comprise at least two stubs connecting to a wall of the waveguide, and wherein the at least two stubs vary in size from one another.

* * * * *